United States Patent [19]

Olin et al.

[11] 4,027,594

[45] June 7, 1977

[54] DISINTEGRATING LEAD SHOT

[75] Inventors: John Merrill Olin, St. Louis, Mo.; Venkataramaraj Subbaraj Urs, Godfrey, Ill.

[73] Assignee: Olin Corporation, New Haven, Conn.

[22] Filed: June 21, 1976

[21] Appl. No.: 698,440

[52] U.S. Cl. ..... 102/92.4; 102/42 R

[51] Int. Cl.[2] ..... F42B 7/00

[58] Field of Search ..... 102/92.3, 92.4, 92.7, 102/42 R; 264/111; 75/.5 R

[56] References Cited

UNITED STATES PATENTS

| | | | |
|---|---|---|---|
| 3,664,824 | 5/1972 | Meadus et al. | 264/111 |
| 3,900,317 | 8/1975 | Meadus et al. | 102/42 R |

OTHER PUBLICATIONS

*Mining* J *Metallurgy*, Oct. 1937, Lead-magnesium Alloys for the Prevention of Lead Poisoning in Waterfowl, pp. 463–466.

*The American Rifleman*, Sears, Robert N., The Quest for Non-Toxic Shot, vol. 121, No. 12, Dec. 1973, pp. 16, 17.

The Condensed Chemical Dictionary, Eighth Ed., 1971, Van Nostrand Reinhold Co., pp. 713, 714.

*Primary Examiner*—Verlin R. Pendegrass

*Attorney, Agent, or Firm*—Donald R. Motsko; William W. Jones

[57] ABSTRACT

Shot pellets formed from finely divided powder adhered together in pellet form by a thermoplastic polymeric material decomposable in the acid environment of the digestive tract of waterfowl.

15 Claims, No Drawings

DISINTEGRATING LEAD SHOT

It has been know for a number of years that lead shot pellets have accumulated in flyways throughout the country. These pellets are picked up by feeding ducks, ingested and make their way through the duck's digestive system into the gizzard. In the duck's gizzard, the pellets are worn away by the grinding action of the gizzard and lead is absorbed into the blood stream of the duck causing lead poisoning. Lead poisoning can be caused by as little as one or two pellets in the system and can be fatal to the duck in a relatively short period of time. Lead poisoning in waterfowl is a serious problem and a solution to this problem has been sought over a period of years back through the early 1930's.

Whether or not a waterfowl will develop fatal lead poisoning from ingesting lead pellets depends on a number of factors, including the diet of the bird.

Approaches to the solution of this lead poisoning problem in waterfowl have been numerous. One suggested approach has been to alloy lead with some substance which somehow neutralizes the lead and renders it ineffective to cause lead poisoning. Such an approach is suggested in U. S. Pat. No. 1,900,182 issued Mar. 7, 1933, which contemplates the addition of phospor-tin to lead. There have been other suggestions such as the addition of selenium or certain percentages of iron to the slot. The mechanism by which these additives works is not readily explainable and is based on various theories. To the present time, however, we are not aware of any additive to lead which has been proven to have the desired effect of preventing lead poisoning in waterfowl even though studies continue in this area.

A more promising approach, in our view, is the use of shot comprising disintegratable lead pellets. This is based on the observation made in various experiments that finely divided lead will pass rather quickly through a duck's digestive system and will not be absorbed in sufficient quantities to cause blood poisoning. Lead shot then, which will disintegrate into small enough particles to quickly pass through the digestive system when ingested by waterfowl, can be made which is non-poisonous to waterfowl. Several approaches have been made in the past to make disintegratable lead pellets. To our knowledge, each has sufficient disadvantages to prevent its commercial application.

One approach suggested by the prior art has been to add a small percentage of a substance such as magnesium to a lead pellet which is supposed to aid in the disintegration of the lead pellet when it comes into contact with water. The theory behind this approach being that the lead pellet will soon disintegrate in the stream or lake and, therefore, not become a danger to feeding waterfowl. If the pellet is ingested before it disintegrates, it will nevertheless rapidly decompose in the moist digestive system of the waterfowl aided by the grinding action of the gizzard. This approach is suggested in U.S. Pat No 2,167,828. To our knowledge, however, the theory has not worked in practice and the magnesium additive has only been marginally effective in aiding in the decomposition of the shot in a manner effective to render the lead non-poisonous. Another approach suggested in U. S. Pat. No. 3,664,824 has been to agglomerate powdered lead bonded by a small portion of watersensitive adhesive into a lead pellet which will then disintegrate in a moist atmosphere. One of the disadvantages of this approach is that such pellets designed to disintegrate in a moist atmosphere will also disintegrate in various parts of the waterfowl's body when embedded therein. The resulting finely divided lead might then pose a danger to a person eating waterfowl containing such lead particles embedded in the flesh or skin. Altough it might be possible to coat such water-soluble lead shot to prevent its disintegration under the skin of waterfowl, this would add cost and uncertainty to the disintegration of the pellet.

We have, therefore, concluded that a new approach is necessary to producing effective disintegrating shot pellets which will overcome the disadvantages inherent in the prior art suggestions. We have determined that a shot pellet can be made commercially which will disintegrate in a fowl's digestive system when acted upon by its acid environment (with a pH ranging from 1–1 ) but which will not become a hazard to humans when embedded in a more neutral moist environment such as found under the waterfowl's skin or in lakes and streams. We have determined that finely divided lead particles held together in a pellet form by a minor amount of a binder decomposable in an acid environment but substantially stable in a neutral moist environment would have superior advantages of safety and reliability over what has been suggested in the past.

It is therefore, an object of this invention to provide a disintegratable lead pellet which will break up in the high acid environment found in a waterfowl's digestive tract but will remain intact or stable in a more neutral moist environment.

It is, more specifically, an object of this invention to provide a lead pellet formed from finely divided lead particles bound together by a thermoplastic polymeric material which will disintegrate in an acid environment but which is stable in storage, in air and under water over a wide ambient temperature range.

These and other advantages will become more readily apparent from the following detailed description of the invention as set forth below.

DETAILED DESCRIPTION

Lead shot is made in accordance with the present invention by blending finely divided particulate lead with an acid decomposable binder and forming it into a pellet which is stable under ordinary conditions but which will disintegrate back into the original lead particles in an environment and under conditions such as exist in a duck's gizzard. It has been found that the pH of a duck's gizzard is normally of low pH and measures about 2.0 to 4.0; usually 2.0 to 3.0. The temperature in the gizzard is about 107.6° F and there is a grinding action on materials lodged in the gizzard. In experiments with ducks, it has been noted that lead particles of a size less than 500 microns pass rather quickly through a duck's system and are eliminated by a duck with drastically reduced mortality. The lead shot made in accordance with this invention has a high density, good strength and is stable under ordnary conditions of storage and handling. The binder is selected so that the pellet will not break down in water or under normal or even extreme moisture conditions. The pellet will break down into fnely divided lead particles when ingested by a waterfowl and subjected to the acid conditions, temperature and grinding action found in a duck's gizzard.

One group of binders we have identified which meet the criteria set forth above are comprised of acetal linkage-containing polymers such as polyvinyl acetals exemplified by polyvinyl formal, polyvinyl acetal, polyvinyl butyral and the like. These material act as an excellent binder for lead and other metal particles. Lead shot made with such a binder has good strength and high density. It is stable under ordinary handling conditions and will maintain its integrity in ordinary moisture including immersion in water. The shot of this invention made with finely divided lead held together with an acid decomposable binder as disclosed herein exhibits yielding characteristics similar to ordinary dropped lead shot. By the proper selection and proportion of binder and method of forming the pellet, the shot can be made to approach the density of dropped lead. Another binder which it is believed would be useful and exhibit the same characteristics is polyacetal.

Lead particles of a size 500 microns or less are mixed according to this invention with an acid decomposable binder such as exemplified by polyvinyl formal and polyvinyl butyral. The binder is added in an amount of 0.5 to 10% by weight. A preferred range of binder is 1 to 5% by weight. The mixture is then formed into pellets. The pellets produced by this mixture are stable under even extreme handling and moisture conditions. They will, however, break up in an environment such as exists in a duck's gizzard.

The environment in a duck's gizzard is simulated for experimental purposes by using a vigorously agitated (with a teflon-coated magnetic stirrer) one molar aqueous solution of sodium chloride whose pH is adjusted to 2.0 by the addition of dilute hydrochloric acid and the temperature of the solution is raised to 107° to 108° F. The temperature of the duck's gizzard is 107.6° F (42° C).

The break up of the shot in the gizzard environment is presumably due to the break down of the acetal linkages in the polymeric binder by the small amounts of hydrochloric acid present and the acetal linkage break down is accelerated by the higher temperature (107.7° F) prevailing in the gizzard environment. It is believed that the acid present in the gizzard decomposes the selected binder such as polyvinyl formal or polyvinyl butyral into readily soluble polyvinyl alcohol.

The disintegrating shot of this invention can be made in a number of different ways. These include compacting into pellets lad particles, e.g., powder, coated with acetal linkage-containing polymer from an organic solvent. Another method is compacting a thoroughly blended mixture of lead particles and the said polymer into a wire, cutting out slugs of predetermined weight from the wire and swaging the slug into a shot. A further suggested method includes agglomerating the lead particles, using the said acid soluble polymer as a binder, into a spherical shot. These and other methods of forming pellets from finely divided lead and binder will be apparent to those skilled in the art and the suggested methods of making set forth above are not meant to limit the invention in any way.

The examples set forth below illustrate the invention but in no way limit the spirit and scope of the invention.

EXAMPLE 1

A. Three hundred grams of lead powder with a particle size distribution of 40 microns to 400 microns were placed in a jacketed sigma blade mixer. Nine grams (i.e., three per cent based on the weight of lead powder) of polyvinyl formal (weight average molecular weight 26000, hydroxyl content 6%, acetate content 22%, polyvinyl formal content 68%), dissolved in 250 millileters of 60/40 mixture of toluene and ethyl alcohol were added into the mixer. The contents of the mixer were thoroughly blended for 30 minutes. The organic solvents were evaporated off from the contents of the mixer by circulating hot water through its jacket. After the solvent was removed, a free-flowing lead powder with a coating of polyvinyl formal was obtained.

Fifteen hundredths of a gram of the above lead powder was placed in a 0.128 inch diameter cylindrical mold and was compacted under pressure from an 80 pound compressed air line for 10 seconds. The cylindrical slug thus formed was taken out from the mold and was swaged into a number four spherical shot (diameter 0.130 inches). About 200 shots were made by this procedure. The density of this shot was found to be 8.20 grams per cubic centimeter.

B. An environment simulating a duck's gizzard was prepared by taking 200 milliliters of one molar aqueous sodum chloride solution in a beaker and adjusting the pH of the solution to 2.0 by the addition of a few drops of hydrochloric acid. About six small porcelain spheres as well as a teflon-coated magnetic stirrer were introduced into the beaker. The beaker was warmed on a thermostatically controlled hot plate and the temperature of the contents of the beaker as raised to 107° to 108° F (duck's gizzard temperature is 107.6 ° F). The contents of the beaker were kept agitated with the aid of a magnetic stirrer.

Three lead shots made as per the above description (Section A) were introduced into the beaker and the agitation was continued. After a lapse of 4 hours, the shots had completely disintegrated into a fine powder. An analysis of the supernatant liquid in the beaker showed only about two parts per million (ppm) of soluble lead ions.

C. Experiment B was repeated except for the fact that the temperature of the contents of the beaker was kept at the ambient temperature of 70° F. Even after a lapse of 5 days, the shots retained their shape and did not break down into powder as had happened at the duck's gizzard temperature. However, analysis of the solution in the beaker showed a high concentration (277 ppm) of soluble lead ions.

EXAMPLE II

A. Three hundred grams of lead powder, with a particle size distribution from 40 microns to 400 microns, was thoroughly mixed with 7.5 grams (i.e., 2.5% based on the weight of lead powder) of dry polyvinyl formal (same as that used in Example I) powder in a blender and the mixture was compacted first into a 0.128 inch diameter and 0.098 inch high cylinder, which was subsequently swaged into a number four shot. About 50 shots were made by this procedure. The density of the shot was 8.77 grams per cubic centimeter.

B. Three shots from the above sample were subjected to a grinding action in a simulated duck's gizzard environment as described under Example I-B, and after 6 hours, the shots disintegrated into a fine powder.

C. The above experiment B was repeated, except for the fact that the temperature of the contents of the beaker was kept at an ambient temperature of 70° F. At the end of 7 days, the shots had retained their integrity and had not disintegrated into a powder. However, the shots had decreased in size by about 40 percent.

EXAMPLE III

A. Higher density shots from powdered lead were made by blending lead powder with 1.5 and 2.0 percent polyvinyl formal binder and compacting the mixtures as described in Examples I and II. The densities of the shots were as follows:

1.5% Binder, 98.5% Lead Powder — Density 10.2 gms/cc 2.0% Binder, 98.0% Lead Powder — Denisty 9.2 gms/cc B. Three shots from lead powder containing 2.0 percent polyvinyl formal binder were subjected to a grinding action in a simulated duck's gizzard environment and the shots disintegrated into a fine powder in less than 12 hours.

EXAMPLE IV

A. Three hundred grams of lead powder with particle size distribution from 40 microns to 400 microns were thoroughly blended with 7.5 grams (i.e., 2.5% based on the weight of lead powder) of dry polyvinyl butyral powder (molecular weight 45000, hydroxyl content 9%, acetate content 3% and polyvinyl butyral content 88%) and the blend was compacted into number 4 shots (diameter 0.130") in exactly the same manner as in Example I. Density of the shot was 7.8 grams per cubic centimeter.

B. Three shots from the above preparation (IV-A) were subjected to the grinding action in a simulated duck's gizzard environment. The shots disintegrated into a powder in about 24 hours.

Preparation of the lead shot from lead powder and the acetal linkage-containing polymeric binder is of commercial importance as such a shot can be used in non-toxic waterfowl ammunition. The shot has a high density and a desirably low hardness unlike steel shot. The spray shot that lands in the ponds and lakes would stay intact until it is picked up by a duck. Shot imbedded in the flesh of the duck would stay intact. When the duck ingests the shot, the shot will disintegrate into a powder in the gizzard and the duck will eliminate the lead powder from its digestive tract without experiencing the poisonous effect of soluble lead ions.

This invention is also useful in making a disintegratable shot or a bullet from other metallic particles such as tungsten, depleted uranium, copper, iron, etc, and acetal linkage-containing polymeric binder, as well as with other binders having the same characteristics.

It is understood that the above description and examples are meant to illustrate and describe the invention without in any way limiting the spirit or scope of the invention.

We claim:

1. A pellet formed from finely divided lead particles adhered together into a pellet by a minor amount of a binder, said binder being decomposable in an acid environment such as found in the gizzard of a duck but substantially permanently stable in a more neutral moist environment.

2. The pellet of claim 1 in which said binder is a polymeric acetal.

3. The pellet of claim 1 in which said binder is a polymeric acetal from the group consisting of polyvinyl formal, polyvinyl acetal and polyvinyl butyral.

4. The pellet of claim 1 in which said binder is polyvinyl formal.

5. The pellet of claim 1 in which said binder is polyvinyl acetal.

6. The pellet of claim 1 in which said binder is polyvinyl butyral.

7. The pellet of claim 1 in which said bender represents 0.5 to 10% of the weight of said pellet.

8. The pellet of claim 1 in which said binder represents 1 to 5% of the total weight of said pellet.

9. Disintegrating lead shot made from lead particles and a binder from the class of polymeric materials, containing a plurality of acetal linkages from the group consisting of polyvinyl formal, polyvinyl acetal and polyvinyl butryral so that said lead shot disintegrates into particles in an acid medium (pH 1 to 4 ) and at temperatures of 105° to 108° F, such as those that prevail in a duck's gizzard.

10. Disintegrating lead shot of high density comprising finely divided lead particles adhered together into a pellet with a small amount of an acid decomposable bincder which will disintegrate into finely divided lead particles under the conditions of acidity and temperature found in the digestive system of waterfowl but which is relatively permanently stable under less acid conditions of high humidity or when immersed in water.

11. Disintegrating lead shot made from finely divided lead particles adhered together into a pellet by a minor amount of binder made from polymeric material, said binder being decomposable in an environment having a pH of 1 to 4 and a temperature exceeding 100° F but relatively permanently stable when immersed in less acid water.

12. The shot of claim 11 in which said binder is a polyvinyl acetal.

13. The shot of claim 11 in which said binder is a polymeric acetal from the group consisting of polyvinyl formal, polyvinyl acetal and polyvinyl butyral.

14. The shot in claim 11 in which said amount of binder is 0.5 to 10% by weight of said pellet.

15. A pellet formed from finely divided metal particles adhered together with a binder releasable in an environment simulating a duck's gizzard in temperature, acidity and agitation but relatively permanently stable under less acid water or in a high humidity environment.

* * * * *

UNITED STATES PATENT OFFICE

CERTIFICATE OF CORRECTION

Patent No. 4,027,594 Dated June 7, 1977

Inventor(s) John M. Olin and Venkataramaraj S. Urs

It is certified that error appears in the above-identified patent and that said Letters Patent are hereby corrected as shown below:

Col. 1, line 29, change "slot" to --shot--;

Col. 2, line 6, change "Altough" to --Although--;

Col. 2, line 16, change "1-1" to --1-4--;

Col. 2, line 58, change "ordnary" to --ordinary--;

Col. 3, line 2, change "material" to --materials--;

Col. 3, line 46, change "lad" to --lead--;

Col. 4, line 28, change "as" to --was--;

Col. 5, line 35, change "spray" to --stray--;

Col. 6, line 14, change "bender" to --binder--;

Col. 6, line 29, change "bincder" to --binder--;

Col. 6, line 47, change "in" first occurence to -- of --.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*